US005369919A

United States Patent [19]

Lohausen

[11] Patent Number: 5,369,919

[45] Date of Patent: Dec. 6, 1994

[54] ARTICULATED ARM AWNING

[75] Inventor: Viktor Lohausen, Oberheinriet, Germany

[73] Assignee: Technolizenz Est., Triesen, Liechtenstein

[21] Appl. No.: 927,668

[22] PCT Filed: Mar. 13, 1991

[86] PCT No.: PCT/EP91/00465

§ 371 Date: May 20, 1993

§ 102(e) Date: May 20, 1993

[87] PCT Pub. No.: WO91/16512

PCT Pub. Date: Oct. 31, 1991

[30] Foreign Application Priority Data

Apr. 12, 1990 [DE] Germany ..... 4011876

[51] Int. Cl.[5] ..... E04F 10/06

[52] U.S. Cl. ..... 52/73; 52/74; 160/22; 160/70

[58] Field of Search ..... 52/74, 73; 160/22, 66, 160/67, 70, 79

[56] References Cited

U.S. PATENT DOCUMENTS

| | | | |
|---|---|---|---|
| 2,038,259 | 4/1936 | Anton | 160/70 |
| 3,782,443 | 1/1974 | Clauss et al. | 160/22 |
| 5,232,036 | 8/1993 | Brutsaert | 160/70 |

FOREIGN PATENT DOCUMENTS

| | | | |
|---|---|---|---|
| 2817759 | 11/1978 | Germany | 52/74 |

*Primary Examiner*—James L. Ridgill, Jr.
*Attorney, Agent, or Firm*—Sughrue, Mion, Zinn, Macpeak & Seas

[57] ABSTRACT

The invention relates to an articulated arm awning with a pivoted cloth shaft for the awning cloth, which can be extended to its position of use under pretension and which is attached to a fall bar at its other end, and with only a single articulated arm (6, 7) subject to an elongating force, whereby a device generating an elongating force is provided at the joint connecting the articulated arm with the fall bar (4) which spans this joint. A further element (11) is provided after the fall bar joint (10) and connected with this joint, whereby this element serves to secure and/or hold one end of the device (14) generating an elongating force for this joint, and whereby this element runs essentially parallel to the fall bar (4) and is preferably integrated in the latter.

6 Claims, 1 Drawing Sheet

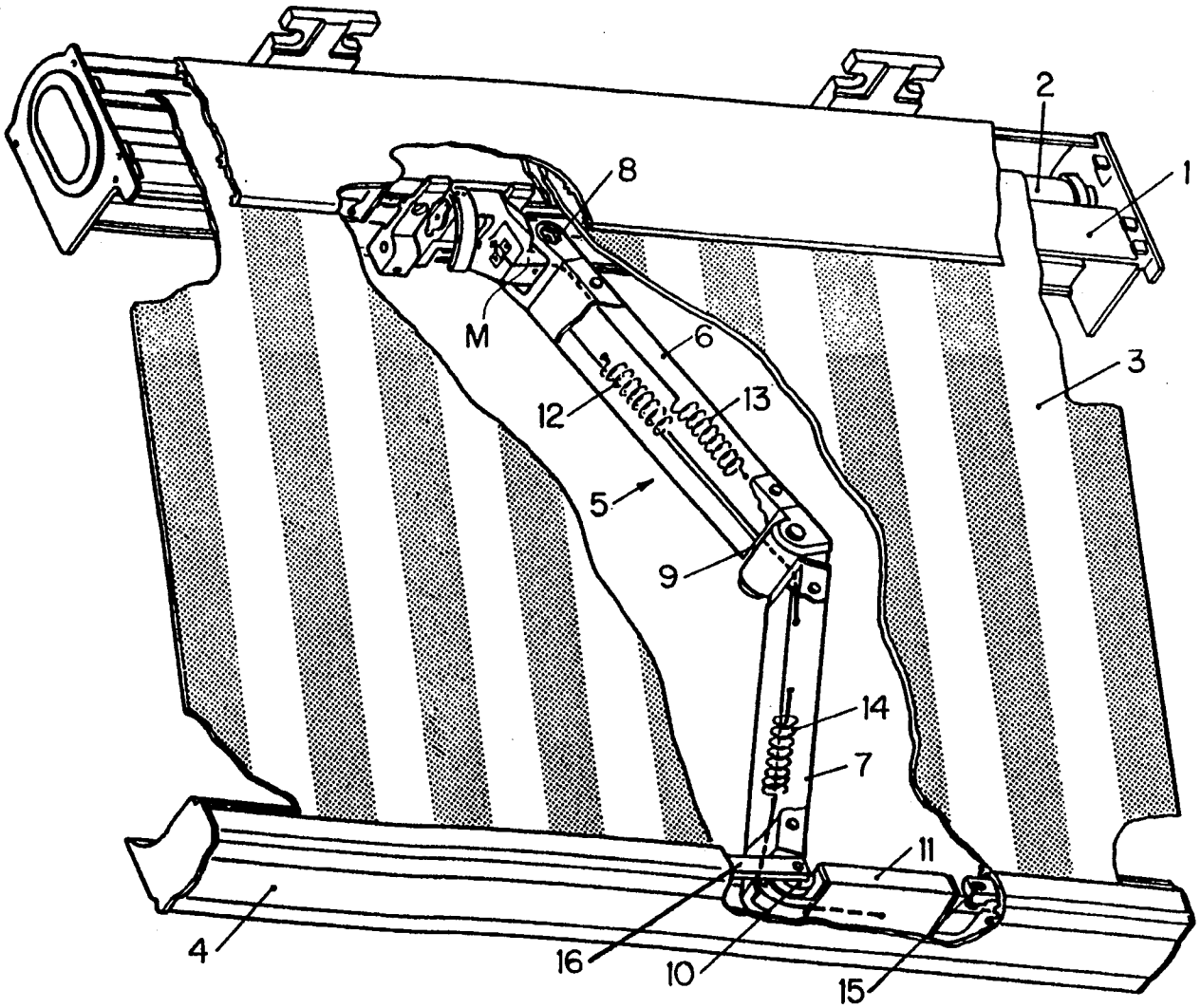
1
2
3
4
5
6
7
8
9
10
11
12
13
14
15
16
M

ARTICULATED ARM AWNING

The invention relates to an articulated arm awning.

Such awnings have been known for a long time and in a wide variety of designs.

All previously known articulated arm awnings possess at least two articulated arms with at least two elements which are connected with each other at the center pivot and are connected at their other ends in an articulated manner with a bracket or similar at the wall or ceiling attachment point as well as being connected with the fall bar or drop bar. At least the center pivot is equipped with a spring device which spans the joint and generates an expanding or elongating force. For example, DE-A 32 43 025 describes an articulated arm awning with several articulated arms, where gas pressure springs are located between a transverse tube secured to the building and the inner elements of the articulated arms or/and between the outer elements of the articulated arms and the fall bar, whereby the spring tension increases constantly during extension of the awning.

This type of articulated arm awning is normally suitable for use for large widths and awnings with a large overhang. However, if it is wished to construct especially narrow awnings which still have a large overhang, it is not possible to achieve smaller width dimensions beyond a certain minimum width, since the two articulated arms would impair each other.

A solution suggested for slightly narrower awnings is described in DE 29 04 884 C 2. In the case of the articulated arm awning described here, the articulated arms are arranged in superposed planes, so that they do not hinder each other during retraction of the awning. However, this has the disadvantage that the overall height of the awning is considerably increased.

A different solution is described in DE 27 43 748. There, an articulated arm awning is described where the swivel pin of an articulated arm is mounted on the drop bar under spring tension so that it can be moved and laterally displaced. In this solution, the reduction in width is often insufficient.

The task of the invention is to create an articulated arm awning of the type mentioned at the start which allows considerably reduced width dimensions to be achieved without increasing the overall height.

The task of the invention is solved by the characteristics of appended claims.

Further embodiments of the invention are contained in the other patent claims.

The invention will now be described in more detail on the basis of an example embodiment in conjunction with the enclosed drawing.

The drawing shows a housing 1, which contains a pivoted cloth shaft 2 which can be driven in the normal way by a (not shown) drive for extension and retraction of the awning. The awning cloth 3 which can be wound onto this cloth shaft is secured in the usual way to a fall bar 4 at its outer end. The articulated arm 5, which consists here of two parts, namely the first and second articulated arm elements 6 and 7, is attached to a main bar M of the housing at the top by a pivot joint 8 forming a first hinge, possesses a center pivot 9 forming a second hinge and is connected with the fall bar 4 by the fall bar joint 10 forming a third hinge.

Such an articulated arm can naturally also consist of more than two elements, particularly in the case of articulated arm awnings with a large overhang. In addition, it is by no means necessary that the arms are of the same length.

The drive systems required for the extension and retraction movements are naturally also provided. An important feature of this new design is that there is only one articulated arm.

In order to permit this, there is a further arm element section 11 connected to the fall bar joint 10, whereby this section can also be integrated in the fall bar itself.

As is known, spring devices are available for articulated arms of this kind which generate an elongating force so that the articulated arm is extended or folded in during extension or retraction of the articulated arm awning.

Up to now, however, it was not possible to produce a single-arm articulated arm awning. This difficult problem has been solved by incorporating a spring device at the fall bar joint 10 as well in addition to the normally provided spring devices.

In the example embodiment described here, it is possible to see a second spring device 12 in the articulated arm element 6, this being secured around the center pivot 9 in articulated arm element 7 by way of a tension connection. In addition, it is possible to see a first spring device 13 as well as a third spring device 14, whose purpose will now be explained in more detail.

The first spring device 13 is anchored inside the housing 1 by means of a further tension connection routed around joint or hinge 8.

An additional spring device 14 is also shown, whereby this is anchored by way of a tension connection routed around the fall bar joint 10 in the additional arm element 11 or, if the latter is integrated in the fall bar 4, in the bar itself. The fall bar joint 10 is also connected with the fall bar by means of a bracket 16. The additional arm element 11, which may in principle be longer or shorter than shown, is additionally connected with the fall bar 4 at 15. The additional spring device 14 thus ensures that the awning cloth is always tautened. The fall bar 4, which might possibly tend to tilt away at the sides, is stabilized in its horizontal position by the additional arm element 11 and bracket 16.

It is also possible to combine the springs 13 and 14 and their tension connections around joints 9 and 8 to produce a tension connection spanning the three joints. Equally, the spring devices 12 and 14 can be combined so that a tension connection is produced which spans only joints 9 and 10.

Tension springs are shown here, but this must be seen only as an example embodiment. It is naturally also possible to replace the helical springs shown here only as an example by other spring devices such as flat coil springs, leaf springs or gas springs or even by gas pressure shock absorbers which exert an elongating force on the respective joint so that the articulated arm is either extended or folded in during extension and retraction of the awning.

It is particularly advantageous if the spring devices are already installed with a certain pretension. It is of particular advantage if readjustment possibilities are also provided for the individual spring devices, thus allowing adjustment of the spring device acting on the fall bar joint to the correct position of the fall bar in particular.

In addition, it is advantageous if a height-adjustment device is provided between the fall bar and fall bar joint which additionally permits the position of the fall bar to be stabilized if necessary.

In the drawing, the articulated arm is shown with its two articulated arm elements folding to the right. The articulated arm can naturally also be designed to fold to the left.

All other drive devices normally fitted on articulated arm awnings, particularly devices for adjustment of the awning slope and spring-up protection and similar are of course also provided.

This new design thus creates an articulated arm awning whose maximum width is determined only by the width of the individual articulated arm elements. If it is therefore wished to obtain articulated arm awnings with very small widths yet large overhangs, it is thus possible to provide articulated arms with 3, 4 or 5 articulated arm elements in the known way. In this case, the individual elements would be joined at their joints in such a way that the individual elements of the articulated arm form a zigzag arrangement when the awning is retracted. In this case, the individual spring devices spanning the various center pivots and fall bar joint and generating an elongating force would have to be correspondingly arranged. However, this does not represent any problem for an expert.

I claim:

1. Articulated arm awning comprising:

a housing which is adapted to be mounted on a wall, said housing containing a pivotable cloth shaft and a main bar;

exclusively, just one articulated arm, said arm having a first articulated arm element, a second articulated arm element and a third arm element, said first articulated arm element being connected to said main bar via a first hinge, said second articulated arm element being connected to said first articulated arm element via a second hinge, said third arm element being connected to said second articulated arm element via a third hinge;

a fall bar connected to said pivotable cloth shaft via an awning cloth, said third arm element being connected to said fall bar, each of said hinges having a swivel axis, said swivel axes being substantially parallel to one another and substantially vertical with respect to said awning cloth;

a first tension spring device connected between said main bar and said first articulated arm element;

a second tension spring device connected between said first articulated arm element and said second articulated arm element;

a third tension spring device connected between said second articulated arm element and said third arm element, each of said tension spring devices being guided around an outer side of a corresponding one of said swivel axes of said hinges in order to generate an elongating force on said articulated arm.

2. An awning according to claim 1, wherein said third element is integrated in and aligned with said fall bar.

3. An awning according to claim 1, further comprising a height adjusting element between said third arm element and said fall bar.

4. An awning according to claim 1, wherein each of said tension spring devices comprises one of helical springs, flat coil springs, leaf springs and gas springs.

5. An awning according to claim 1, further comprising additional tension spring devices located on an inner side of said axes of said hinges.

6. An awning according to claim 1, wherein said tension spring devices are preloaded with a tension load, said tension load being increased when said fall bar is moved towards said housing.

* * * * *